US012318019B2

(12) United States Patent
Lee et al.

(10) Patent No.: US 12,318,019 B2
(45) Date of Patent: Jun. 3, 2025

(54) TABLEWARE FEEDING DEVICE

(71) Applicant: Kolor Magnetic (Shenzhen) Co., Ltd., Guangdong (CN)

(72) Inventors: Ching Mou Lee, Guangdong (CN); Chi Wai Lee, Guangdong (CN)

(73) Assignee: Kolor Magnetic (Shenzhen) Co., Ltd., Shenzhen (CN)

( * ) Notice: Subject to any disclaimer, the term of this patent is extended or adjusted under 35 U.S.C. 154(b) by 104 days.

(21) Appl. No.: 18/228,699

(22) Filed: Aug. 1, 2023

(65) Prior Publication Data

US 2024/0398134 A1 Dec. 5, 2024

(30) Foreign Application Priority Data

May 31, 2023 (CN) ..... 202321375833.7

(51) Int. Cl.
*A47F 1/10* (2006.01)

(52) U.S. Cl.
CPC ..... *A47F 1/10* (2013.01)

(58) Field of Classification Search
CPC ..... A47F 1/10
See application file for complete search history.

(56) References Cited

U.S. PATENT DOCUMENTS

2020/0093281 A1* 3/2020 Goltz ..... A47F 1/10

* cited by examiner

*Primary Examiner* — Gene O Crawford
*Assistant Examiner* — Ayodeji T Ojofeitimi

(57) ABSTRACT

This present application involves a tableware feeding device including a stock bin with a supporting component installed below it to support the tableware. Below the supporting component, there is an inclined chute for the tableware to slide down, and at the end of the inclined chute, there is a tableware access opening. It also includes a transmission structure and an actuating component. One end of the transmission structure is connected to one end of the supporting component, and the actuating component consists of multiple baffles, a first actuating member, and a second actuating member. The baffles are positioned at the tableware access opening. When the tableware is pulled, the baffle is dragged along, and it is driven by a transmission structure connected to the first and second movable components. This, in turn, causes the supporting component to rotate, thereby allowing the tableware inside the stock bin to be discharged.

9 Claims, 7 Drawing Sheets

TABLEWARE FEEDING DEVICE

CROSS REFERENCE TO RELATED APPLICATIONS

The present application claims the benefit of Chinese Patent Application No. 202321375833.7 filed on May 31, 2023, the contents of which are incorporated herein by reference in their entirety.

TECHNICAL FIELD

This present application relates to the technical field of tableware manufacturing equipment and specifically involves a tableware feeding device.

BACKGROUND

With the development of the catering industry, disposable tableware has become popular. In order to maintain the cleanliness and storage of disposable tableware, many restaurants have introduced tableware dispensers. Currently, when the tableware dispenser is loaded for the first time, the first piece of tableware needs to be manually operated for blanking due to operational requirements. The current feeding structure of the tableware dispenser involves using one or more support plates to lift the bottom layer of tableware in the stock bin. The feeding and separation of the tableware is achieved by pushing the mechanism forward or rotating the support plates. This operation is complex and inconvenient.

SUMMARY

The present application provides a tableware feeding device with a simple structure that is easy to separate the underlying tableware, aiming to address the deficiencies and shortcomings of existing techniques in tableware handling.

To achieve the above-mentioned objective, the technical solution adopted by this present application is as follows: A tableware feeding device, comprises a stock bin, and a support component installed below the stock bin for supporting the tableware, an inclined chute for sliding tableware is provided below the support component, an tableware access opening is provided at the end of the inclined chute, wherein, a tableware placement section is provided on the support component, the position of the tableware placement section corresponds to the position of the stock bin; a transmission structure and an actuating component are further comprised, one end of the transmission structure is connected to one end of the support component in a transmission way; the actuating component comprises multiple baffles, a first actuating member and a second actuating member; the baffle is positioned at the tableware access opening, while the first actuating member and the second actuating member are installed above the baffles and connected to the transmission structure in a transmission way; the actuating component is used to drive the transmission structure to rotate the tableware placement section and push the tableware into the inclined chute.

Further; the transmission structure comprises a first transmission shaft, a second transmission shaft, a first bevel gear, a second bevel gear, and a first drive gear; the first actuating member and the second actuating member are respectively assembled on the first transmission shaft and the second transmission shaft; surfaces of the first actuating member and the second actuating member are equipped with teeth; the first actuating member and the second actuating member are engaged and connected to each other; a first transmission section on the surface of which is equipped with teeth is provided on the first transmission shaft; the first transmission gear is engaged and connected to the first transmission section; the first transmission gear is also engaged and connected to the first bevel gear; the first bevel gear is further engaged and connected to the second bevel gear; the second bevel gear is assembled at one end of the supporting component.

Further; the supporting component includes a rotating shaft, a rotating wheel, a limit block, and a resetting component; the limit block is installed at the output end of the rotating shaft; a placement slot is opened on one side of the limit block, away from the output end of the rotating shaft; the resetting component is located within the placement slot; the rotating wheel and the second bevel gear are assembled sequentially at the input end of the rotating shaft.

Further; the side of the rotating wheel facing the stock bin is equipped with a placement surface, and the size of the placement surface is suitable for the size of the tableware.

Further; the placement surface consists of a horizontal placement area, which extends upward on one side to form a limit wall.

Further; the stock bin includes a left limit and a right limit, which are located on opposite sides of the rotating shaft; the left limit, the right limit, and the placement area together form a storage space that accommodates the tableware; the tableware is positioned within the storage space.

Further; the storage space is equipped with a blanking port, and the initial end of the inclined chute is provided with a tableware feeding inlet, and the position of the discharge opening corresponds to the position of the tableware feeding inlet.

Further; a gap connected to the tableware access opening is arranged below the baffle.

Further; the first actuating member, the second actuating member and the first transmission section are all fan-shaped gears.

Further; the resetting component is a spiral spring.

The Beneficial Effects of this Application are as Follows:

This present application provides a tableware feeding device that includes a baffle positioned at the tableware access opening. When the tableware is pulled, the baffle is dragged along, and it is driven by a transmission structure connected to the first and second movable components. This, in turn, causes the supporting component to rotate, thereby allowing the tableware inside the stock bin to be discharged. This design not only makes it more convenient and simpler to access the tableware but also facilitates the separation of the underlying tableware, preventing it from getting stuck in the compartment and avoiding deformation.

Additionally, the presence of the baffle prevents insects such as cockroaches and geckos from entering the enclosure and contaminating the tableware.

DETAILED DESCRIPTION OF THE PREFERRED EMBODIMENT

Figure 1:
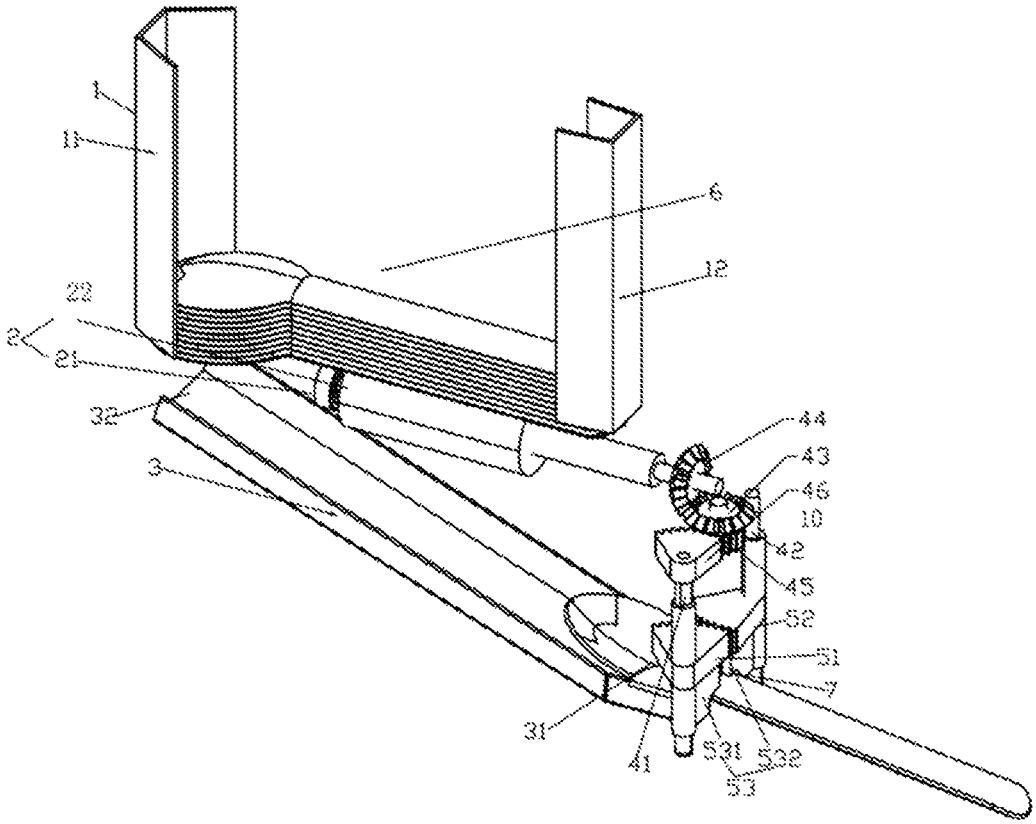
FIG. 1 is a structural schematic diagram of a tableware feeding device according to the present application.
Figure 2:
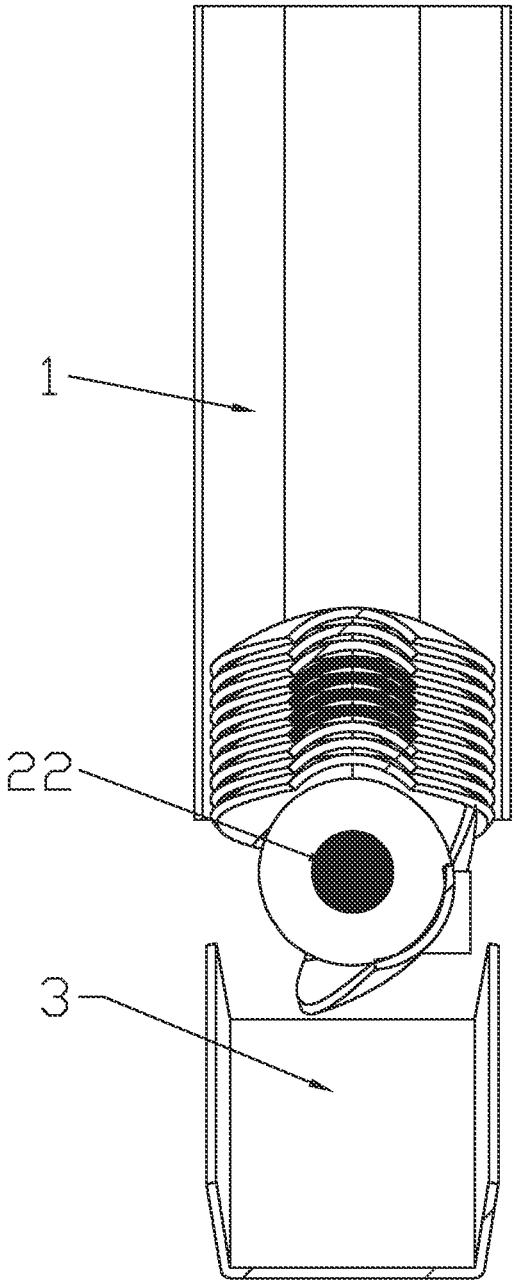
FIG. 2 is a structural schematic diagram of a rotating shaft of the tableware feeding device according to the present application.
Figure 3:
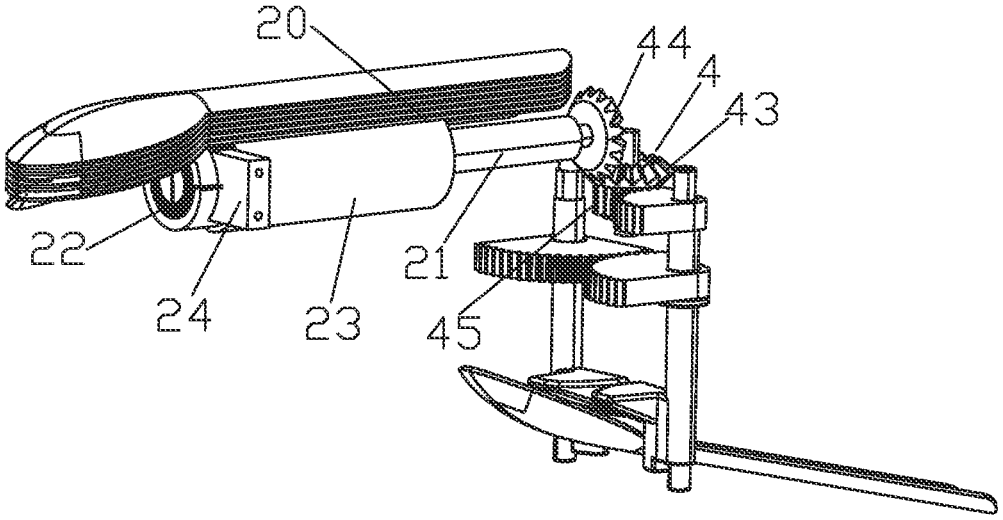
FIG. 3 is a structural schematic diagram of a tableware feeding device from another perspective of the present application.
Figure 4:
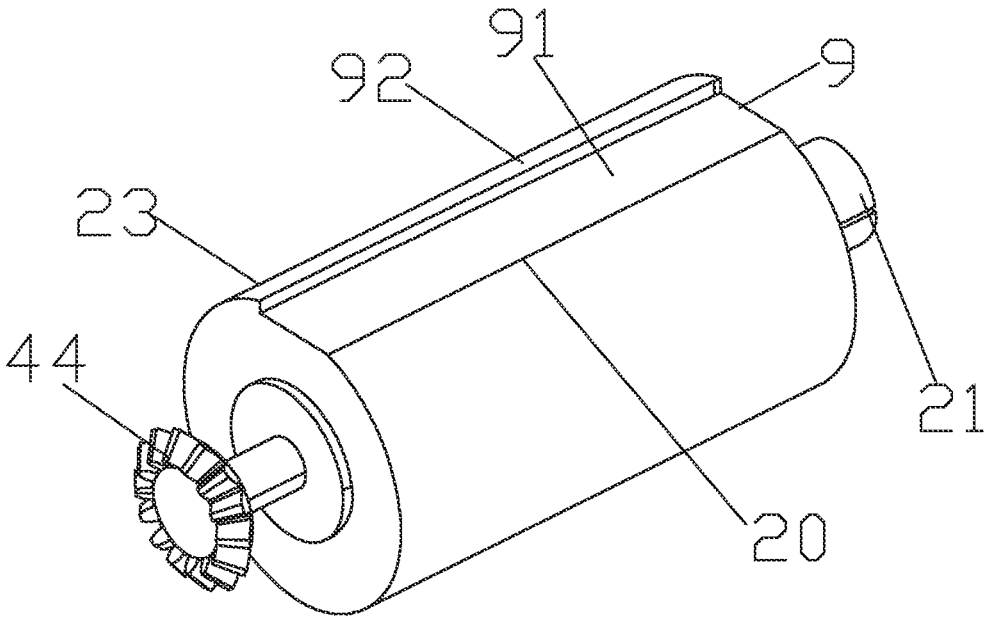
FIG. 4 is a structural schematic diagram of a rotating wheel of the tableware feeding device according to the present application.
Figure 5:
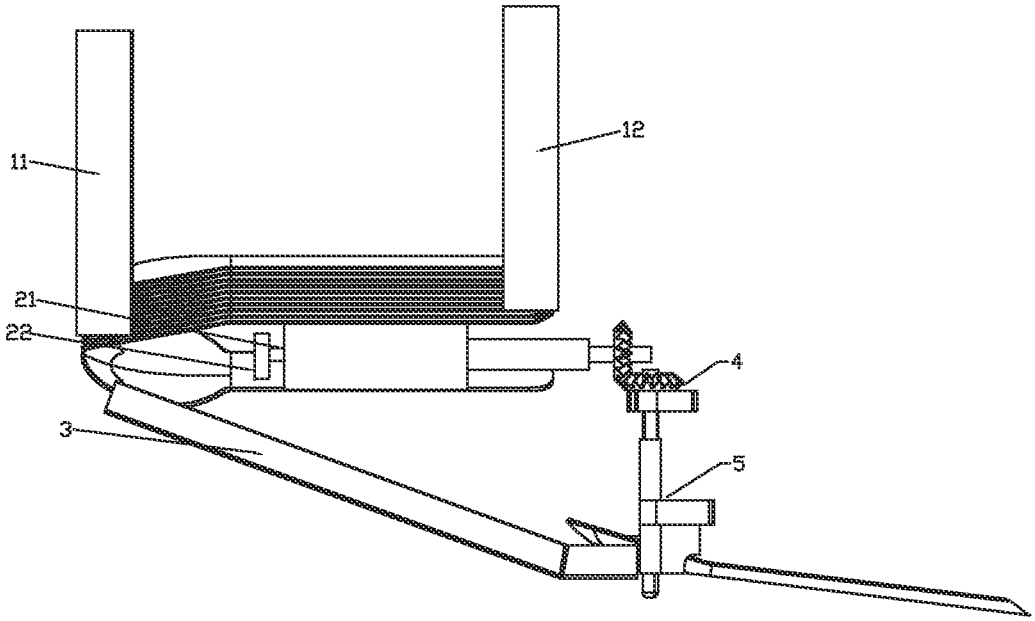
FIG. 5 is a structural schematic diagram of the tableware feeding device in the open state according to the present application.

Based on the accompanying drawings in the embodiments of the present application, the technical solution in the embodiments will be described clearly and comprehensively. It should be noted that the described embodiments are only a part of the embodiments of the present application, and not the entirety of the embodiments. Based on the embodiments of the present application, all other embodiments that ordinary skilled persons in the field can obtain without exercising creative labor are within the scope of protection of the present application.

Certainly, it is clarified that all directional indications (such as up, down, left, right, front, back, etc.) mentioned in the embodiments of the present application are used solely to explain the relative positional relationships and movements between components under a specific posture (as shown in the accompanying drawings). If there is a change in the specific posture, the directional indications will correspondingly change as well.

Additionally, the use of terms such as "first," "second," etc. in the present application is purely for descriptive purposes and should not be understood as indicating or implying relative importance or specifying the quantity of the indicated technical features. Therefore, features described as "first" or "second" may explicitly or implicitly include at least one of such features. Furthermore, the technical solutions among different embodiments can be combined, but only if it is achievable by ordinary skilled persons in the field. If the combination of technical solutions results in contradictions or is unachievable, it should be considered that such combination does not exist and is not within the scope of protection of the present application.

The present application provides a tableware feeding device.

In the embodiment of the present application, as shown in FIGS. 1-5, the tableware feeding device, comprises a stock bin 1, and a support component 2 installed below the stock bin 1 for supporting the tableware, an inclined chute 3 for sliding tableware is provided below the support component 2, an tableware access opening 31 is provided at the end of the inclined chute 3, wherein, a tableware placement section 20 is provided on the support component 2, the position of the tableware placement section corresponds to the position of the stock bin 1; a transmission structure 4 and an actuating component 5 are further comprised, one end of the transmission structure 4 is connected to one end of the support component 2 in a transmission way; the actuating component 5 comprises multiple baffles 53, a first actuating member 51 and a second actuating member 52; the baffle 53 is positioned at the tableware access opening 31, while the first actuating member 51 and the second actuating member 52 are installed above the baffles 53 and connected to the transmission structure 4 in a transmission way; the actuating component 5 is used to drive the transmission structure 4 to rotate the tableware placement section 20 and push the tableware into the inclined chute 3. Specifically, the baffle 53 comprises a first baffle 531 and a second baffle 532.

In this embodiment, the transmission structure 4 comprises a first transmission shaft 41, a second transmission shaft 42, a first bevel gear 43, a second bevel gear 44, and a first drive gear 45; the first actuating member 51 and the second actuating member 52 are respectively assembled on the first transmission shaft 41 and the second transmission shaft 42; surfaces of the first actuating member 51 and the second actuating member 52 are equipped with teeth; the first actuating member 51 and the second actuating member 52 are engaged and connected to each other; a first transmission section 46 on the surface of which is equipped with teeth is provided on the first transmission shaft 41; the first transmission gear 45 is engaged and connected to the first transmission section 46; the first transmission gear 45 is also engaged and connected to the first bevel gear 43; the first bevel gear 43 is further engaged and connected to the second bevel gear 44; the second bevel gear 44 is assembled at one end of the supporting component 2.

In this embodiment, the supporting component 2 includes a rotating shaft 21, a rotating wheel 23, a limit block 24, and a resetting component 22; the limit block 24 is installed at the output end of the rotating shaft 21; a placement slot is opened on one side of the limit block 24, away from the output end of the rotating shaft 21; the resetting component 22 is located within the placement slot; the rotating wheel 23 and the second bevel gear 44 are assembled sequentially at the input end of the rotating shaft 21.

In this embodiment, the side of the rotating wheel 23 facing the stock bin 1 is equipped with a placement surface 9, and the size of the placement surface 9 is suitable for the size of the tableware.

In this embodiment, the placement surface 9 consists of a horizontal placement area 91, which extends upward on one side to form a limit wall 92.

In this embodiment, the stock bin 1 includes a left limit 11 and a right limit 12, which are located on opposite sides of the rotating shaft 21; the left limit 11, the right limit 12, and the placement area 91 together form a storage space 6 that accommodates the tableware; the tableware is positioned within the storage space 6.

In this embodiment, the storage space 6 is equipped with a blanking port, and the initial end of the inclined chute 3 is provided with a tableware feeding inlet 32, and the position of the discharge opening corresponds to the position of the tableware feeding inlet 32.

In this embodiment, a gap 7 connected to the tableware access opening 31 is arranged below the baffle 53. The gap 7 is designed to allow the handle of the tableware to extend out from gap 7 when the tableware is falling. This allows for easy retrieval of the tableware handle during actual usage, without contaminating the food-contacting portion of the tableware. When pulling the tableware from the tableware access opening 31, the tableware can simultaneously pull the baffle 53 and the second baffle 532. This action causes the first baffle 531 and the second blocking plate 532 to rotate. At the same time, the first actuating member 51 and the second actuating member 52 rotate and pull the first transmission section 46 installed on the first transmission shaft 41. This drives the rotation of the first gear, which in turn drives the synchronous rotation of the first bevel gear 43 and the second bevel gear 44. As a result, the rotating shaft 21 is rotated to achieve the feeding function. The direct feeding position of the rotating shaft 21 ensures accuracy and high reliability. It eliminates the need for lateral movement of the tableware during feeding, saving space for forward and backward translation. Additionally, this design reduces friction and minimizes the required driving force during the feeding process.

In this embodiment, the first actuating member 51, the second actuating member 52 and the first transmission section 46 are all fan-shaped gears.

In this embodiment, the resetting component 22 is a spiral spring.

Figure 6:
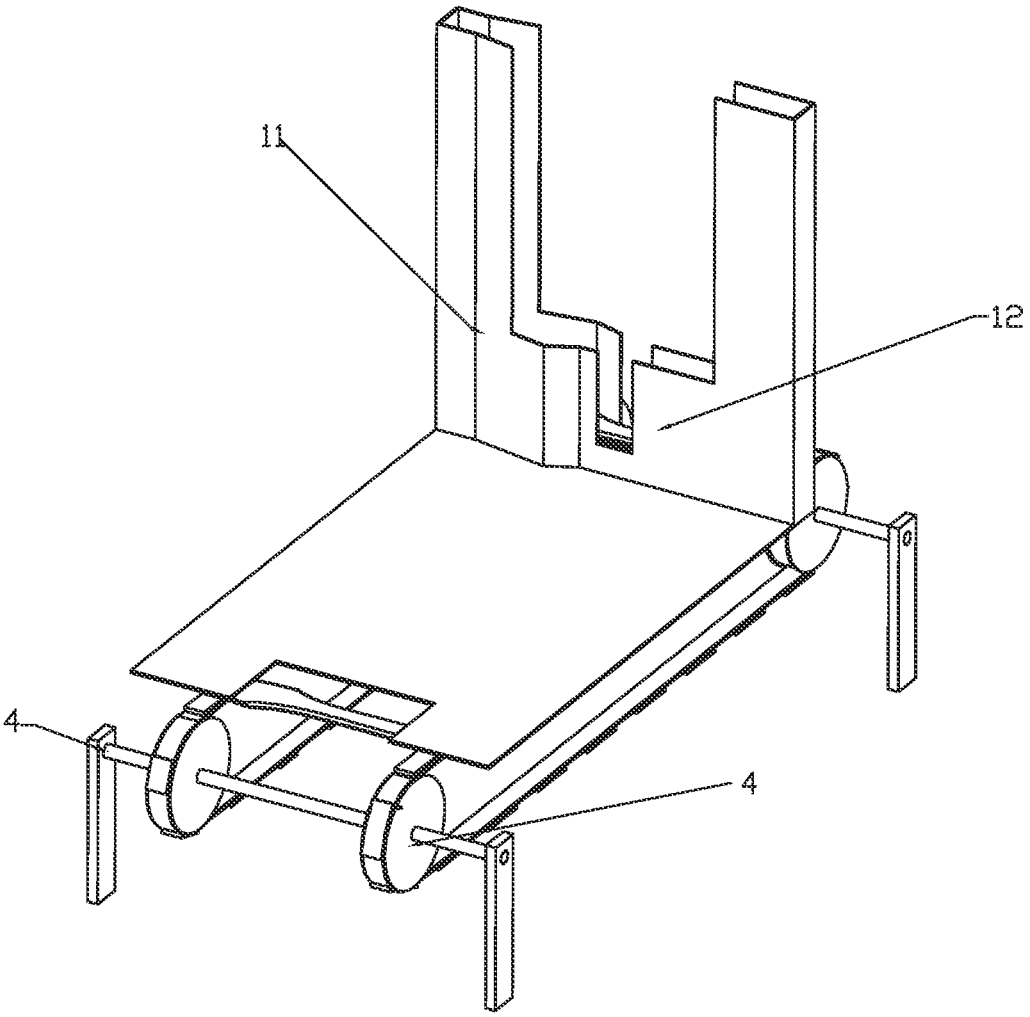
FIG. 6 is a structural schematic diagram of the tableware feeding device according to another embodiment of the present application.

In addition, the present application also has another embodiment, as shown in FIG. 6, where the transmission structure 4 can be changed to a belt-driven feeding mechanism.

Figure 7:
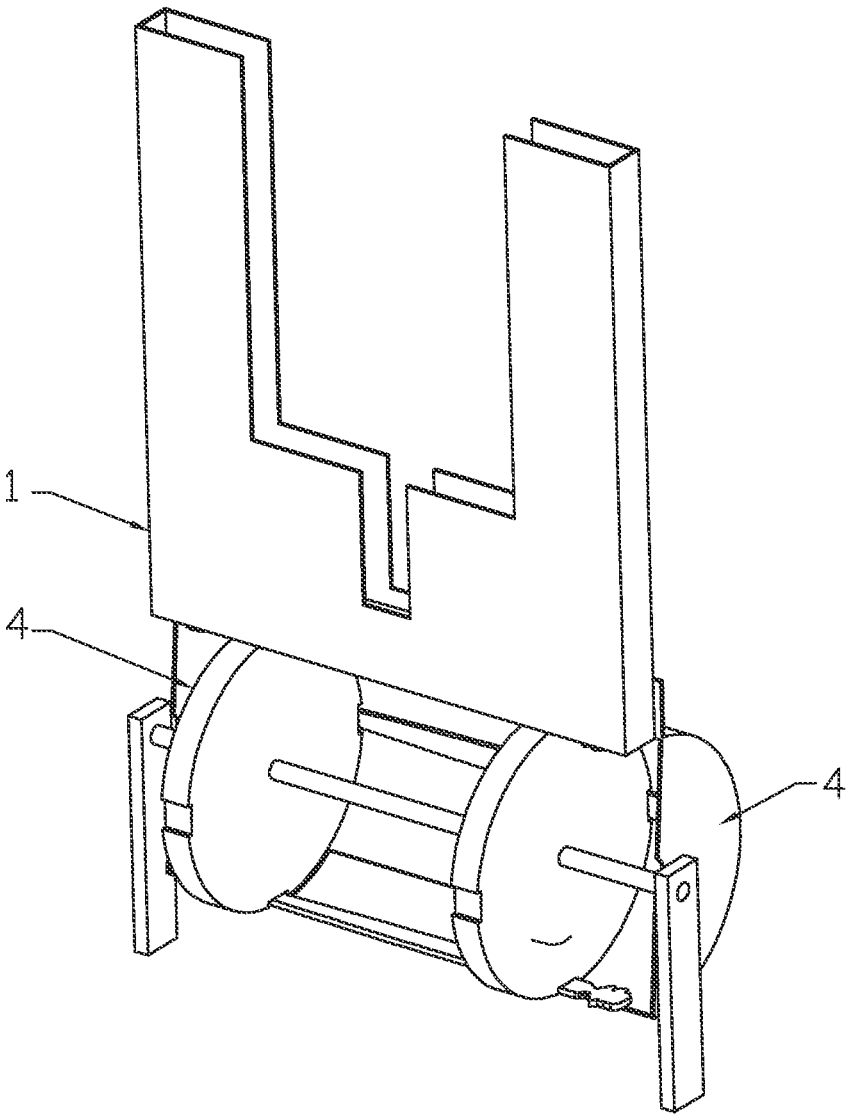
FIG. 7 is a structural schematic diagram of the tableware feeding device according to the other embodiment of the present application.

Furthermore, the present application also has another embodiment, as shown in FIG. 7, where the transmission structure 4 can be changed to a wheel-driven feeding mechanism.

The embodiments described above are preferred examples of this application, but they do not limit the scope of the application's patent. Any equivalent structural modifications made under the concept of this application, as well as direct or indirect applications in other related technical fields using the content of this application specification and accompanying drawings, are also included within the scope of patent protection for this application.

The invention claimed is:

1. A tableware feeding device, comprises a stock bin (1), and a support component (2) installed below the stock bin (1) for supporting the tableware, an inclined chute (3) for sliding tableware is provided below the support component (2), an tableware access opening (31) is provided at the end of the inclined chute (3), wherein, a tableware placement section (20) is provided on the support component (2), the position of the tableware placement section corresponds to the position of the stock bin (1); a transmission structure (4) and an actuating component (5) are further comprised, one end of the transmission structure (4) is connected to one end of the support component (2) in a transmission way; the actuating component (5) comprises multiple baffles (53), a first actuating member (51) and a second actuating member (52); the baffle (53) is positioned at the tableware access opening (31), while the first actuating member (51) and the second actuating member (52) are installed above the baffles (53) and connected to the transmission structure (4) in a transmission way; the actuating component (5) is used to drive the transmission structure (4) to rotate the tableware placement section (20) and push the tableware into the inclined chute (3); the transmission structure (4) comprises a first transmission shaft (41), a second transmission shaft (42), a first bevel gear (43), a second bevel gear (44), and a first drive gear (45); the first actuating member (51) and the second actuating member (52) are respectively assembled on the first transmission shaft (41) and the second transmission shaft (42); surfaces of the first actuating member (51) and the second actuating member (52) are equipped with teeth; the first actuating member (51) and the second actuating member (52) are engaged and connected to each other; a first transmission section (46) on the surface of which is equipped with teeth is provided on the first transmission shaft (41); the first transmission gear (45) is engaged and connected to the first transmission section (46); the first transmission gear (45) is also engaged and connected to the first bevel gear (43); the first bevel gear (43) is further engaged and connected to the second bevel gear (44); the second bevel gear (44) is assembled at one end of the supporting component (2).

2. The tableware feeding device according to claim 1, wherein, the supporting component (2) includes a rotating shaft (21), a rotating wheel (23), a limit block (24), and a resetting component (22); the limit block (24) is installed at the output end of the rotating shaft (21); a placement slot is opened on one side of the limit block (24), away from the output end of the rotating shaft (21); the resetting component (22) is located within the placement slot; the rotating wheel (23) and the second bevel gear (44) are assembled sequentially at the input end of the rotating shaft (21).

3. The tableware feeding device according to claim 2, wherein, the side of the rotating wheel (23) facing the stock bin (1) is equipped with a placement surface (9), and the size of the placement surface (9) is suitable for the size of the tableware.

4. The tableware feeding device according to claim 3, wherein, the placement surface (9) consists of a horizontal placement area (91), which extends upward on one side to form a limit wall (92).

5. The tableware feeding device according to claim 4, wherein, the stock bin (1) includes a left limit (11) and a right limit (12), which are located on opposite sides of the rotating shaft (21); the left limit (11), the right limit (12), and the placement area (91) together form a storage space (6) that accommodates the tableware; the tableware is positioned within the storage space (6).

6. The tableware feeding device according to claim 5, wherein, the storage space (6) is equipped with a blanking port, and the initial end of the inclined chute (3) is provided with a tableware feeding inlet (7), and the position of the discharge opening corresponds to the position of the tableware feeding inlet (7).

7. The tableware feeding device according to claim 1, wherein, a gap (8) connected to the tableware access opening (31) is arranged below the baffle (53).

8. The tableware feeding device according to claim 1, wherein, the first actuating member (51), the second actuating member (52) and the first transmission section (46) are all fan-shaped gears.

9. The tableware feeding device according to claim 2, wherein, the resetting component (22) is a spiral spring.

* * * * *